United States Patent [19]

Dysarz

[11] Patent Number: 5,002,432

[45] Date of Patent: Mar. 26, 1991

[54] DEVICE AND METHOD TO CUT AND COIL PILES, CASINGS AND CONDUCTORS

[75] Inventor: Edward D. Dysarz, Houston, Tex.

[73] Assignee: Dynovation Design & Engineering Inc., Houston, Tex.

[21] Appl. No.: 306,793

[22] Filed: Feb. 6, 1989

Related U.S. Application Data

[63] Continuation-in-part of Ser. No. 77,108, Jul. 22, 1987, abandoned.

[51] Int. Cl.[5] ..... E02D 9/04

[52] U.S. Cl. ..... 405/195; 30/92.5; 166/55.2; 405/228; 405/232

[58] Field of Search ..... 405/154, 184, 227, 228, 405/232, 195; 166/55.2, 55.3; 30/92.5

[56] References Cited

U.S. PATENT DOCUMENTS 4,720,211 1/1988 Streatfield et al. ..... 405/154

FOREIGN PATENT DOCUMENTS 767372 7/1949 Fed. Rep. of Germany ..... 30/92.5

2000989 9/1971 Fed. Rep. of Germany ..... 405/228

821653 4/1981 U.S.S.R. ..... 405/228

*Primary Examiner*—David H. Corbin

[57] ABSTRACT

A cutter-coiler device that economically cuts and coils cylindrical piles, casings and conductor pipes to a depth below the surface of the sea floor. Although the device will cut and coil cylindrical piles, casings and conductor pipes above the sea floor, it is most effective for use where casings, conductors and piles must be cut, and pushed or coiled below the sea floor. Further, although the device is effective in cutting and coiling casings, conductors and piles that are cut below the sea floor, it is also effective on cutting and coiling cylindrical piles casings and conductor pipes that must be cut above the sea floor. The device includes a conventional pile driver or hammer, an anvil, a helmet, a spreader coiler, a coiler, cutter blades and a guide. The guide directs the cutter blades into the casing where the cutter blades cut the casing into sections and the spreader coiler pushes out on the sections causing the cut sections to flatten out and the coiler forces the section to roll up into a coil.

9 Claims, 9 Drawing Sheets

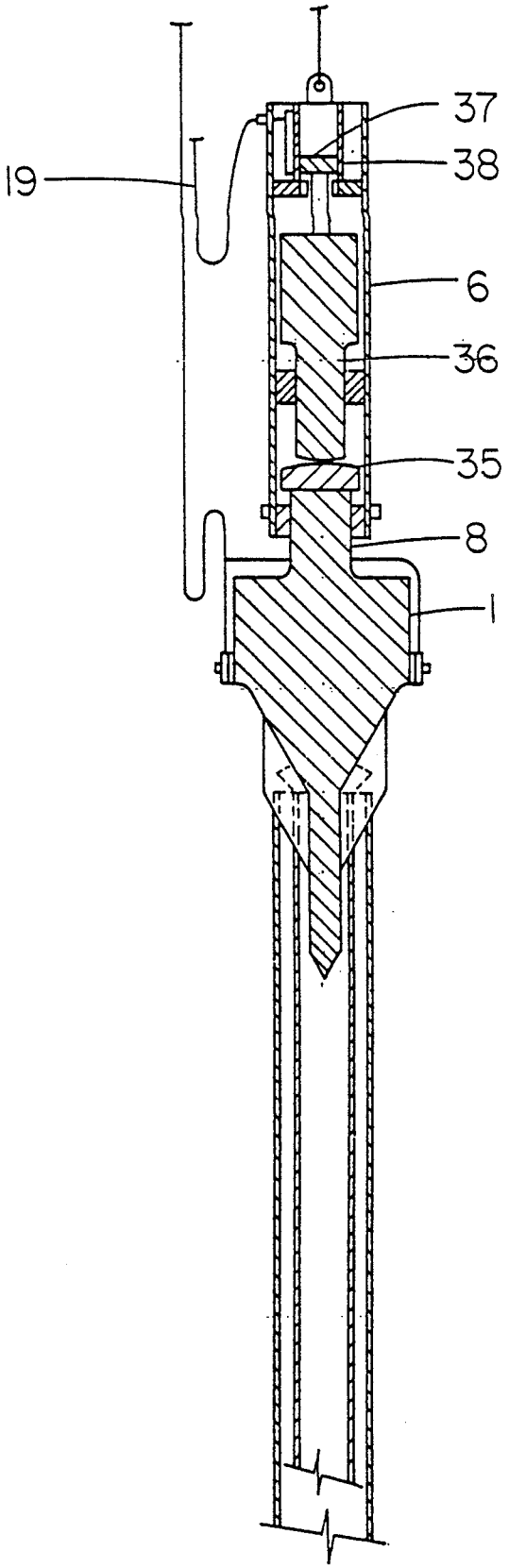
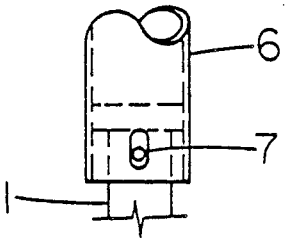
FIGURE 3B
FIGURE 3A

DEVICE AND METHOD TO CUT AND COIL PILES, CASINGS AND CONDUCTORS

This application is a continuation -in- part of U.S. Pat. application Ser. No. 07/077,108 filed July 22, 1987, now abandoned.

BACKGROUND OF THE INVENTION

1. Field of the Invention

The present invention relates to the demolition of offshore production platforms and more particularly to the removal of the remaining casings, conductors, and piles that may protrude above the sea floor.

2. Description of Prior Art

In the offshore industry, there are many marine structures that support casings and conductors for the production of gas and petroleum. These casings and conductors are tubes of various diameters that extend from deep into the sea floor up to the production deck of the offshore marine structure; they are used as conduits to carry petroleum and gas from a reservoir deep within the earth to a gathering and process location on the offshore marine structure above the sea floor and also above the surface of the sea.

The offshore marine structure is also supported and held in place of the sea floor by round piles. When the offshore marine structure is removed, often the piles are left protruding above the sea floor. To remove the piles, a diver must enter into the pile and cut it below the sea floor. After the pile has been cut below the sea floor, the pile section that protruded above the sea floor and the section that is below the sea floor is removed by a crane located on a surface vessel. This is both expensive and time consuming.

To cut a casing and conductor below the mudline, a cutting tool is placed inside of the casing and conductor and they are cut; care must be taken to keep the casing and conductor in tension at all times to prevent the vertical casing and conductor from collapsing downward onto the cutter blades thereby jamming the blades and further preventing their removal.

When the first inside casing is removed, another cutter with a greater diameter is placed inside of the conductor and it is cut in the same manner as the casing. This procedure is both time consuming and expensive. If there is concrete or grout between the casing and conductor or in the annuals formed by the two tubes, the cutter will not work properly.

If the casing cannot be cut from the inside, it must therefore be cut from the outside and it still must be cut as least fifteen feet (15') below the sea floor. To cut the casing or conductor of pile below the sea floor, a hole must be excavated around the casing and conductor or pile. The excavation must be more that fifteen feet (15') deep to allow a diver to enter into the excavation with sufficient room to cut the casing and conductor of pile. The digging of the excavation is very expensive and time consuming. The cutting of the casing and conductor or pile by a diver from within the excavation is dangerous, time consuming and expensive.

While the diver is cutting the casing and conductor or pile from within the excavation, the casing and conductor or pile could fall over onto the diver. There is also a great danger of the walls of the excavation collapsing on the diver as he cuts the casing, conductor or pile.

There are several other methods of severing and crushing piles, etc. One method is found in a patent issued in the Soviet Union, Patent number PRCS Q42 A6931 E/03 SU-821-653. This is a method of severing concrete piles above a surface such as a sea floor or above the ground on land. This system does not however sever piles below the surface; the piles still remain extending above the surface after they are severed. There is another device that destroys cast iron pipes. This device is shown in U.S. Pat. No. 4,720,211 issued to STREATFIELD et al on Jan. 19, 1988. This method does break up cast iron pipe below the surface of the ground but it does not coil the pipe that is on or above the surface to be buried below the surface of the ground.

OBJECTS OF THE INVENTION

In the preferred embodiment, the "Device to cut and coil Subsea Casings, Conductors and Piles" may be equipped with a jetting system to blow away the topsoil on the sea floor to the desired depth thus allowing the casing, conductor or pile sufficient space to cut or to coil out. The device of the preferred embodiment may also be equipped with a means to be guided down to the casing, conductor or pile that is to be cut and coiled.

Accordingly, it is the object of this invention to provide an apparatus for efficiently removing a casing, conductor or pile that is projecting above the surface of the ground or sea floor to an elevation below the sea floor to conform with the prevailing laws and regulations for clearing away objects that project above the sea floor.

Another object of the present invention is to destroy a casing, conductor or pile in a safe manner.

A further object of the present invention is to destroy a casing, conductor or pile without damaging the subsea environment or destroying marine life.

BRIEF DESCRIPTION OF THE DRAWINGS

For further understanding of the nature and objects of the present invention, reference should be had to the following detailed description of the preferred embodiment thereof taken in conjunction with the accompanying drawings, in which like parts are given like numerals and wherein;

FIG. 3A is a section elevation of the present invention showing the pile hammer when it strikes the cutter-coiler.

FIG. 3B is a partial elevation of the connection between the pile hammer and the cutter-coiler.

FIG. 6 is an elevation view of a casing and conductor after the apparatus of the present invention has been removed and the excavation in the sea floor has been filled in.

DETAILED DESCRIPTION OF THE PREFERRED EMBODIMENT

The preferred embodiment of the present invention may be used to cut and coil casing, conductors or piles that are protruding above the sea floor to an acceptable depth below the sea floor. When the casing, conductor or pile is cut and coiled below the surface of the sea floor, it will be covered with soil by man made means or by natural means where it will eventually corrode away.

The ability to cut and coil cylindrical piles, casings and conductor pipes into the sea floor without causing harm to the environment or marine life is due to the application of a subsea pile driver on the device. The forces of the subsea pile driver will not cause damage to the environment as explosives do.

Although the preferred embodiment of the invention places more emphasis on cutting and coiling casings, cylindrical piles and conductor pipes, the device could also crush concrete contained in the annulus formed by the casing and conductor.

DEVICE AND ITS METHOD OF USE

Figure 1:
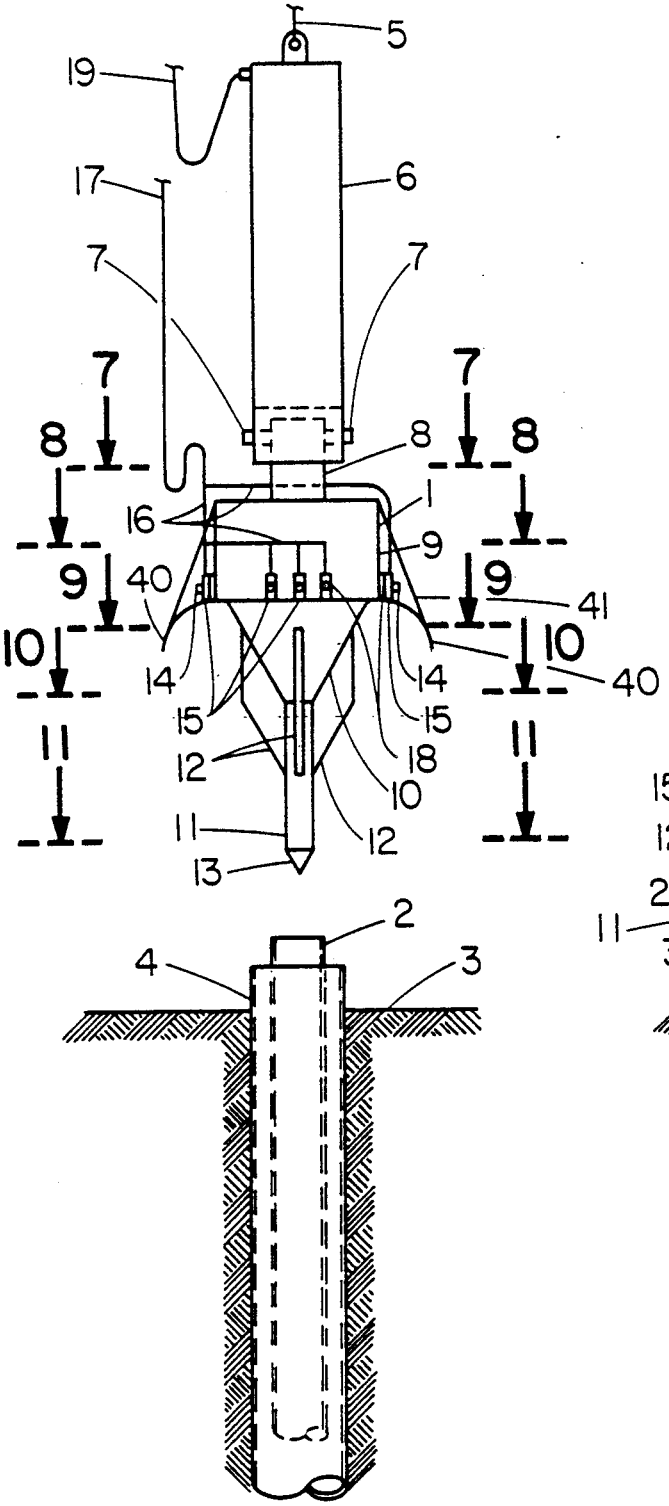
FIG. 1 is an elevation view of the preferred embodiment of the apparatus of the present invention shown while being lowered into a casing and conductor.

Referring to FIG. 1, there is shown the cutter-coiler 1. The cutter-coiler 1 is being lowered into a casing 2 that has been severed above the sea floor 3. The casing 2 is inside of a conductor 4 that has also been cut above the sea floor 3.

The casing cutter-coiler 1 is further shown being lowered into place by a cable 5 that is suitably attached to the subsea pile hammer 6. The other end of the cable 5 is connected to a crane or winch not shown that is located on a vessel or ship not shown.

The subsea pile hammer 6 is suitably fastened to the casing cutter-coiler 1 by trunnions 7 located on each side of the anvil 8. The trunnions 7 support the casing cutter-coiler 1 but allow it to rotate as it is being lowered and operated. The trunnions 7 hold the subsea pile hammer 6 by fitting into suitable cutouts in the wall of the subsea pile hammer 6.

The anvil 8 is suitably connected to the helmet 9 which adds weight or mass to the casing cutter-coiler 1. The helmet 9 is tapered at the bottom, forming a spreader-coiler 10. At the bottom of the spreader-coiler 10 which is the most narrow section of the spreader coiler 10 is the guide 11. The guide 11 is narrower than the casing to be cut to allow the guide 11 to be inserted into the casing 2. The guide 11 has a point 13 at the end. On the outside of the spreader-coiler 10 and the guide 11 are the cutter blades 12 and the coiler 40. The coiler 40 is a half round member that is supported by the coiler bracket 41.

On the outside lower section of the helmet 9 are horizontal water jet nozzles 14 and vertical water jet nozzles 15. Both the horizontal water jet nozzles 14 and the vertical water jet nozzles 15 are suitable connected to pipes 16 and a flexible tube 17. The flexible tube 17 carries water from a pump not shown located on a vessel above the surface of the sea. The water is pushed through the pipes 16 and into the horizontal water jet nozzle 14 to control the cutter-coiler 1 in a horizontal mode as it is being lowered into a casing 2. The water is also pushed into the vertical water jet nozzle 15 to jet out an excavation in the sea floor 3 to allow the coiled casing 2 and conductor pipe 4 to be buried. Both water jets nozzles 14 and 15 are controlled by valves not shown contained in the water jet housing 18.

The subsea pile hammer 6 receives its power and control from the hammer power and control line 19 that is suitably fastened to the necessary machinery located on a vessel on the surface of the sea.

Figure 2:
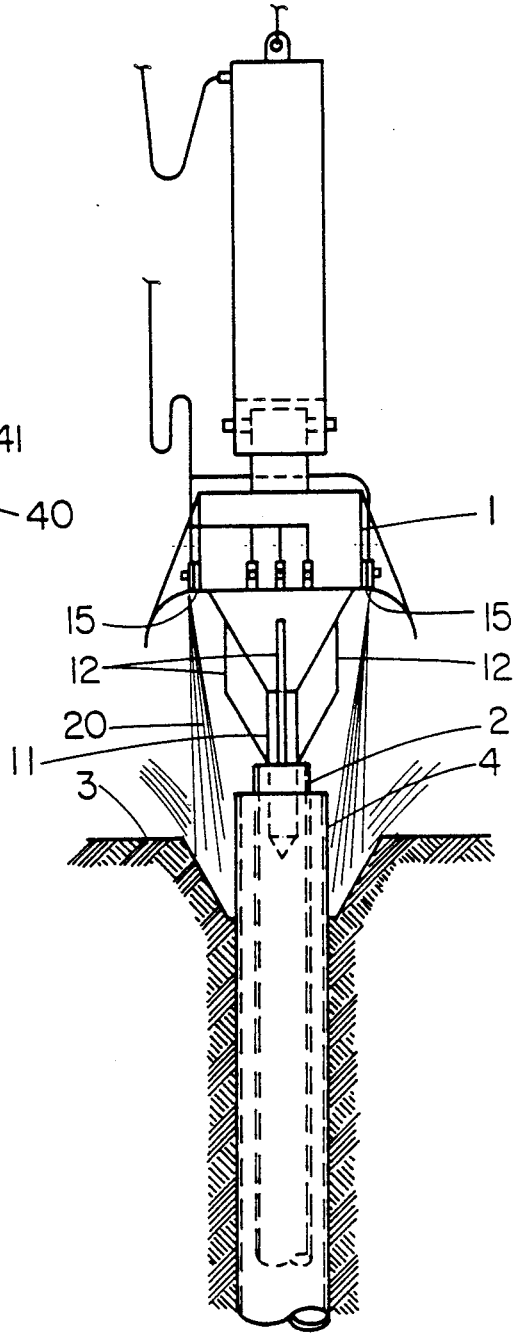
FIG. 2 is an elevation view of the present invention after the apparatus has been lowered into the casing, conductor or pile while the jetting system is excavating the sea floor.

Referring to FIG. 2, there is shown the guide 11 of the cutter-coiler 1 entering into a casing 2 and a conductor pipe 4. The cutter blades 12 are about to cut into the casing 2. The vertical water jet nozzle 15 is jetting water into the sea floor 3 forming an excavation 20 around the conductor pipe 4.

Figure 3:
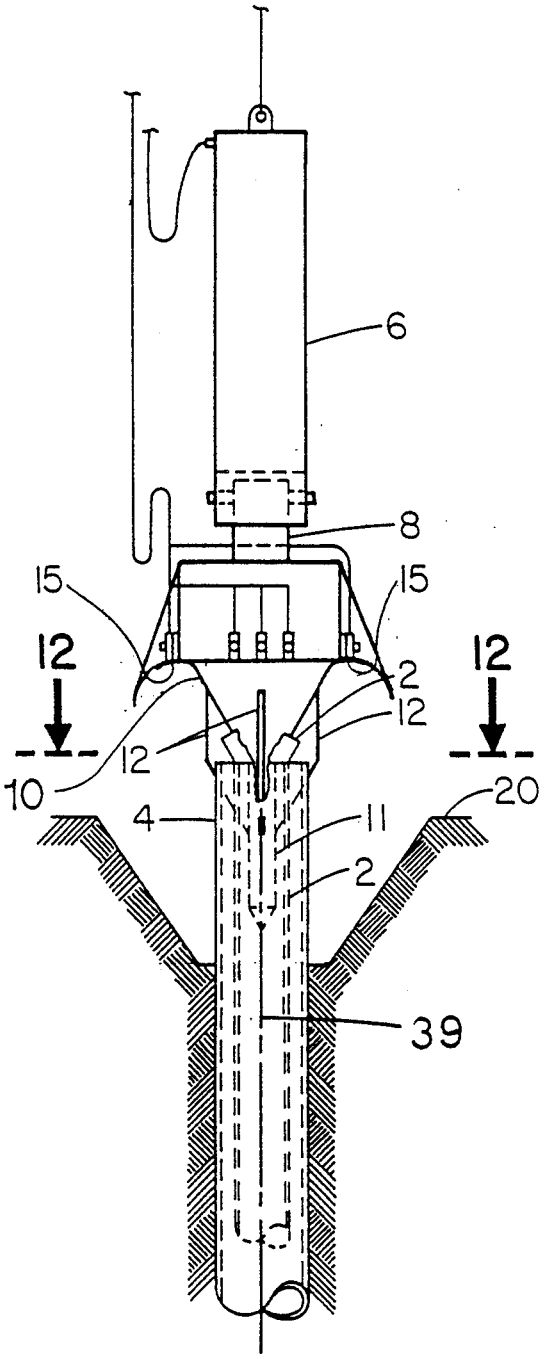
FIG. 3 is an elevation view of the present invention showing a casing and conductor being cut and the sea floor being excavated.

Referring to FIG. 3, there is shown the guide 11 completely inside of the casing 2, holding and guiding the cuttercoiler 1 parallel to the longitudinal axis 39 of a cylindrical pile not shown, casing 2 or conductor pipe. The subsea pile hammer 6 is actuated, striking the anvil 8 causing the cutter blades 12 to cut the casing 2 and the conductor pipe 4. The spreader coiler 10 has already started to spread the casing 2 apart.

The vertical water jet nozzles 15 are shown jetting water to enlarge the excavation 20.

Referring to FIG. 3A there is shown a section elevation of the subsea pile hammer 6, the cutter-coiler 1, the casing 2 and conductor pipe 4 as they work together.

The subsea pile hammer 6 shown is a conventional subsea pile hammer that is used extensively in the North Sea area. It is a hydraulic type of hammer that has been designed to work under water at great depths. The subsea pile hammer 6 has just struck the anvil 8 of the cutter-coiler 1 and it is ready to move up for another stroke. The anvil 8 was struck by the hammer anvil 35 in the following manner. High pressure hydraulic fluid is pumped from a pump not shown located above the surface of the sea, into the hammer power and control line 19 where it is forced into the cylinder 38. The hydraulic pressure reacts on the piston 37 pounding the ram 36 onto the hammer anvil 35 and the hammer anvil 35 is pounded onto the anvil 8. The force of the blow by the ram 36 is also greatly assisted by gravity.

Referring to FIG. 3B there is shown a side view for the means of fastening the subsea pile hammer 6 onto the cuttercoiler 1 with the trunnion 7.

The trunnion 7 is inserted into a slot cut into the subsea pile hammer 6 and a hole cut into the anvil 8.

Figure 3C:
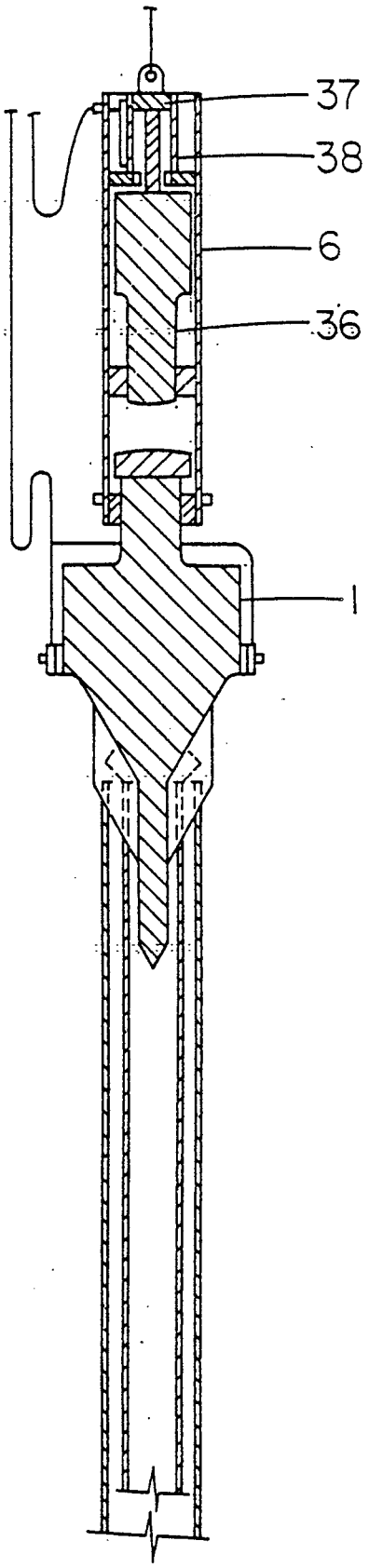
FIG. 3C is a section elevation of the present invention showing the hammer as it is retracted to strike another blow.

Referring to FIG. 3C there is shown a section elevation of the subsea pile hammer 6 at the high point of its stroke before the ram 36 is pounded into the cutter-coiler 1.

Hydraulic fluid is forced into the lower part of the cylinder 38 pushing up on the lower end of the piston 37 thus raising the piston 37 which in turn elevates the ram 36 to its highest point before marking its downward stroke which is described in FIG. 3A.

Figure 4:
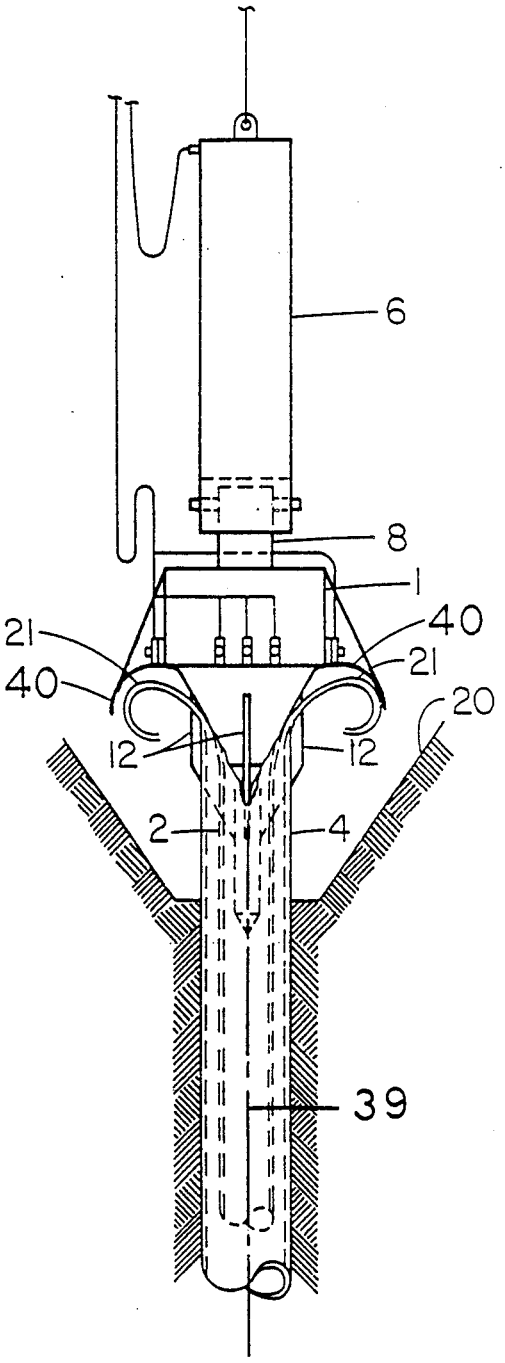
FIG. 4 is an elevation view of the present invention showing a casing and conductor being cut and coiled into the sea floor.

Referring to FIG. 4, there is shown the subsea pile hammer 6 striking the anvil 8 of the cutter-coiler 1 causing the cutter blades 12 to further cut the casing 2 and conductor pipe 4. The spreader-coiler 10 and the coiler 40 are shown impacting the casing 2 and conductor 4 causing the split casing 2 and conductor 4 to flatten out horizontally or perpendicular to the longitudinal axis 39 of the casing 2 or conductor 4 and roll out together into a coil 21. The coils 21 are rolled up in the excavation 20.

Figure 5:
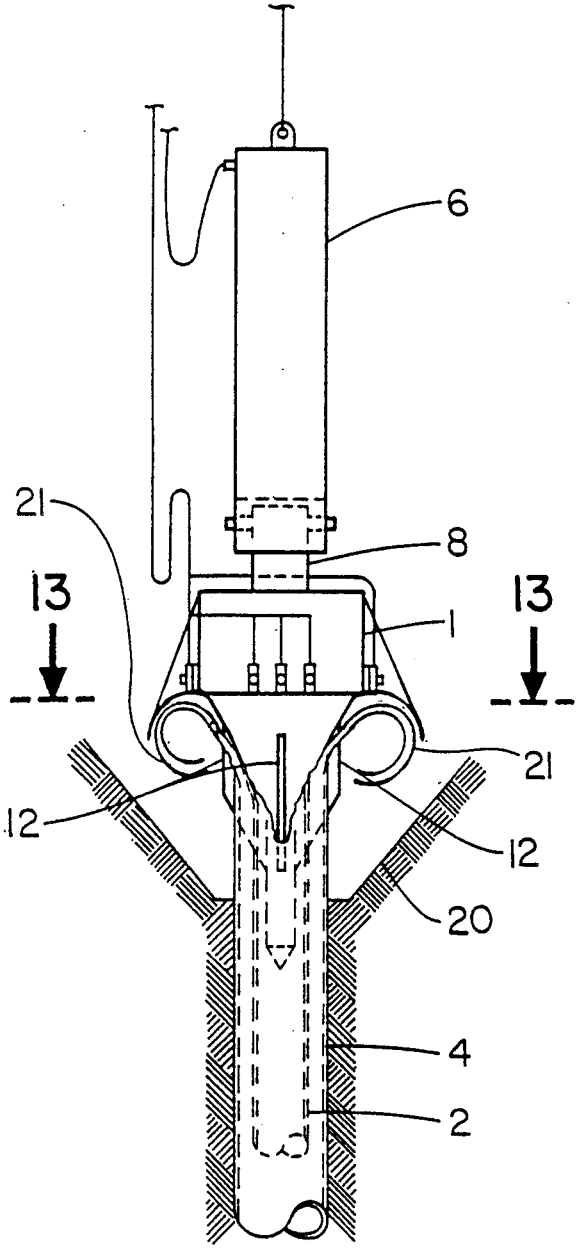
FIG. 5 is an elevation view of the present invention showing a casing and conductor being cut and coiled further below the sea floor.

Referring to FIG. 5, there is shown the subsea pile hammer 6 striking the anvil 8 of the cutter-coiler 1 causing the cutter blades 12 to continue to cut the casing 2 and conductor pipe 4 at even greater depths. The coiler 40 is shown forcing the casing 2 and the conductor pipe 4 to further roll into a coil 21.

The coils 21 are a greater diameter and the excavation 20 is both deeper and wider.

Figure 6:
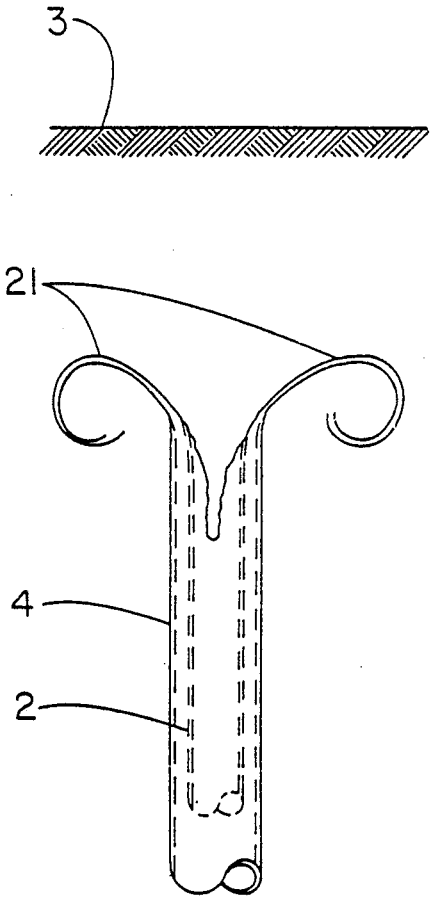

Referring to FIG. 6, there is shown the cutter-coiler removed from the casing 2 and the conductor pipe 4. The excavation in the sea floor 3 has been filled in by natural means or other means and the coils 21 from casing 2 and conductor pipe 4 are left to corrode away.

Figure 7:
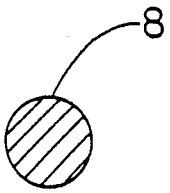
FIG. 7 is a section view of the guide of the apparatus taken through FIG. 1.

Referring to FIG. 7, ther is shown a cross section view of the anvil 8 as taken from FIG. 1. The anvil 8 is shown as being round but it could also be square depending on the design choice.

Figure 8:
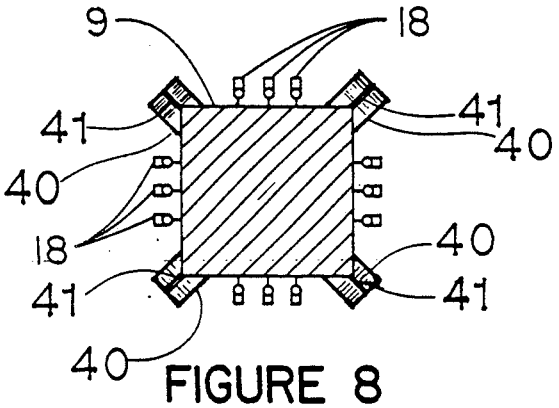
FIG. 8 is a section view of the helmet of the apparatus taken through FIG. 1.

Referring to FIG. 8, there is shown a cross section view of the helmet 9. The coiler is shown on the lower end of the helmet 9. The coiler 40 is supported by the coiler bracket 41.

The water jet housings 18 are shown in various positions on the helmet 9.

Figure 9:
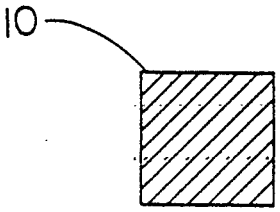
FIG. 9 is a section view of the spreader coiler of the apparatus taken through FIG. 1.

Referring to FIG. 9, there is shown a cross section of the spreader-coiler 10 as taken through FIG. 1.

Figure 10:
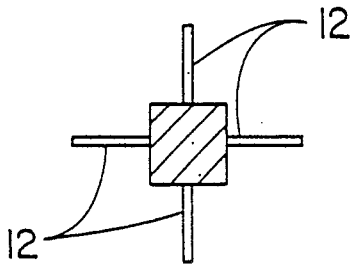
FIG. 10 is a section view of the cutter blades of the apparatus taken through FIG. 1.

Referring to FIG. 10, there is shown a cross section of the cutter blades 12. Four cutter blades 12 are shown, there could however be only two cutter blades 12 required by design choice.

Figure 11:
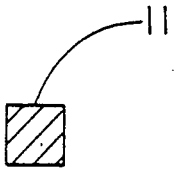
FIG. 11 is a section view of the guide of the apparatus taken through FIG. 1.

Referring to FIG. 11, there is shown a cross section view of the guide 11. Like the other parts, the guide 11 is shown as being square but it could also be round by design choice.

Figure 12:
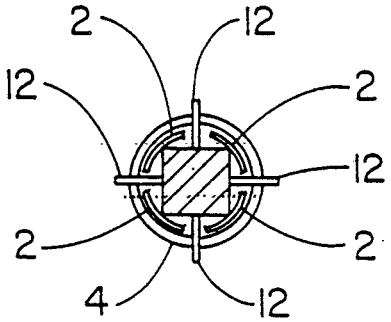
FIG. 12 is a section view taken through FIG. 3, of the cutter blades cutting a conductor and casing.

Referring to FIG. 12, there is shown a section taken through FIG. 3. The cutter blades 12 are shown splitting the casing 2. The conductor pipe 4 on the outside has not yet been split.

Figure 13:
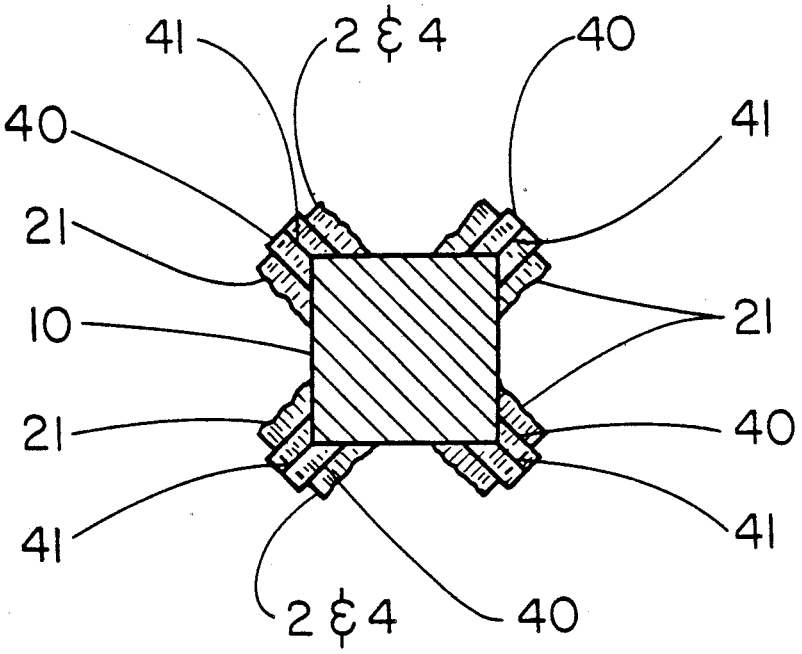
FIG. 13 is a section view taken through FIG. 5, of the spreader coiler as it spreads and coils a casing and conductor.

Referring to FIG. 13, there is shown a section taken through the upper end of the spreader-coiler 10 of FIG. 5. The coilers 40 are shown rolling up the casing 2 and conductor pipe 4 into a coil 21. The coiler 40 is also shown with the coiler bracket 41.

The casing 2 and conductor pipe 4 are shown split and rolled into four coils 21.

Figure 14:
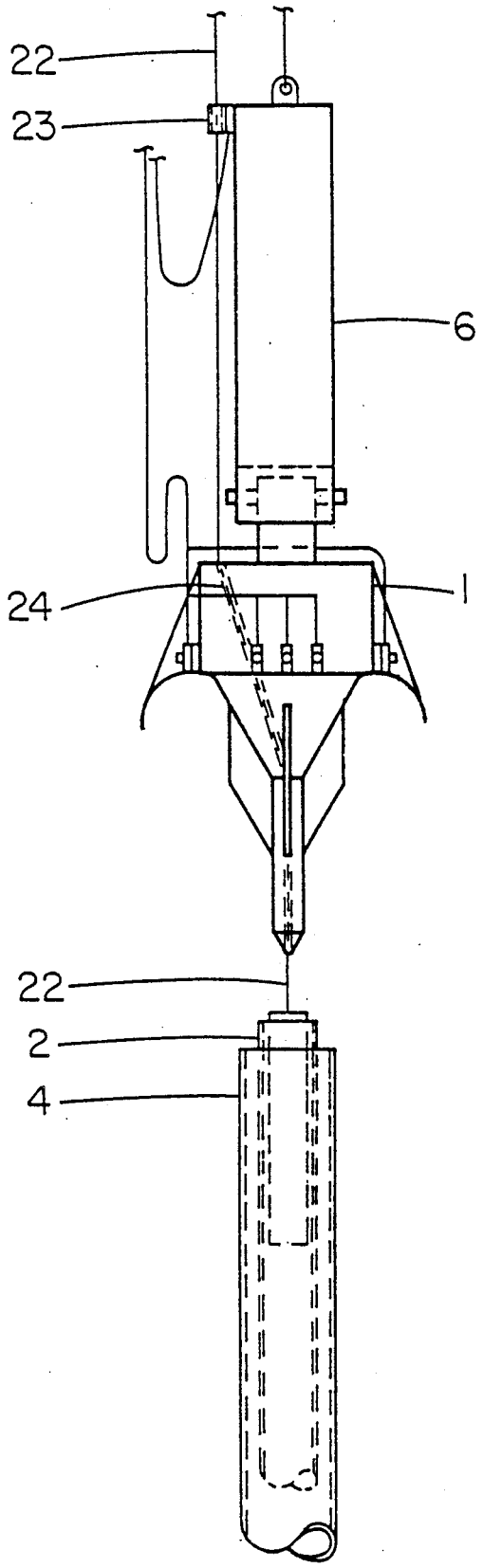
FIG. 14 is an elevation view of another embodiment of the invent showing a guide line system.

Referring to FIG. 14, there is shown another method of controlling or guiding the cutter-coiler 1 into the casing 2 and conductor pipe 4.

A guide line 22 is suitably attached to a vessel not shown that is located on the surface of the sea;the other end of the guide line 22 is suitably fastened to the casing 2 as will be explained with FIGS. 15 and 16.

The guide line 22 is shown running through the hammer guide 23 located near the top of the subsea pile hammer 6. The guide line 22 is further run through the cutter-coiler cable guide 24 cut through the cutter-coiler 1.

Figure 15:
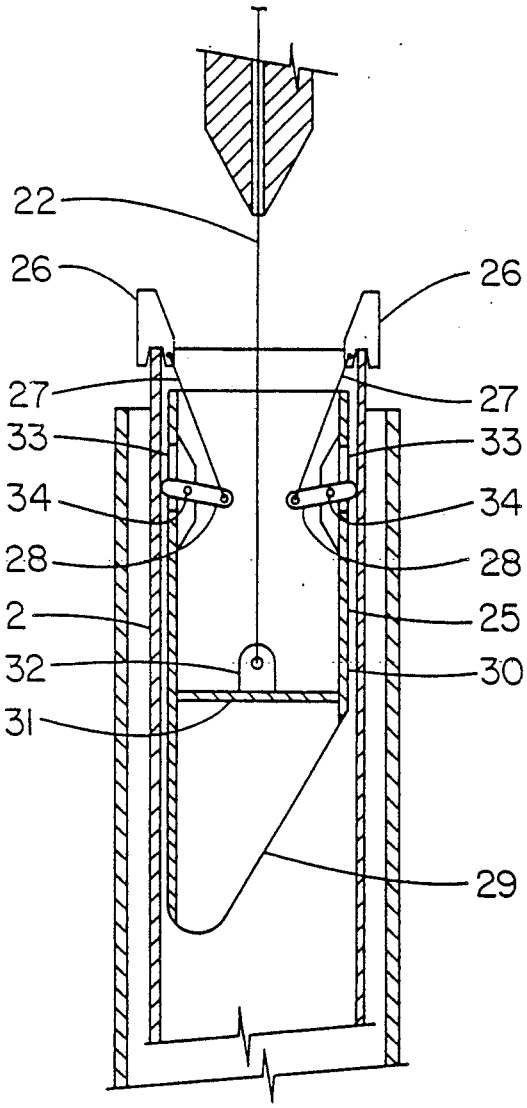
FIG. 15 is a section view taken through part of FIG. 14 showing a device that will hold the guide cable to the casing and conductor.

Referring to FIG. 15, there is shown a section view taken through FIG. 14 of a cable holding device 25.

The cable holding device 25 consists of a guide tube 30 with a point 29 at one end. A foundation plate 31 is suitably fastened to the inside of the guide tube 30 and a pay eye 32 is further suitably fastened to the foundation plate 31. The guide line 22 is suitably fastened to the pad eye 32.

There are two slots 33 cut into the side of the guide tube 30. The slots 33 are cut to allow dogs 28 to rotate past the wall to the guide tube 30 and push into the wall of the casing 2. The dogs 28 are activated when the cable holding device 25 is lowered into the casing 2; before the cable holding device 25 is lowered into the casing 2, a set of tube hooks 26 are placed on the edge of the casing 2. Suitably attached to the tube hooks are pullback lines 27 that are also suitably attached to a dog. When the cable holding device 25 is lowered into the casing 2, the pullback lines 27 pulls on the dogs 28 causing the dogs 28 to rotate on the pin 34 and to further push and lock into the inside wall of the casing 2, thus preventing the cable holding device 25 from moving up or down inside of the casing 2.

Figure 16:
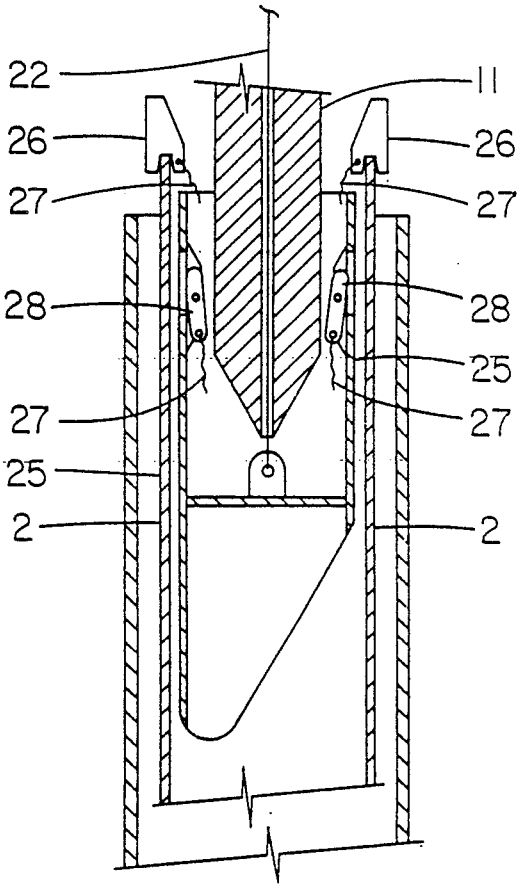
FIG. 16 is a continuation section view of FIG. 15 showing the guide inside of the guide cable holding device.

Referring to FIG. 16, there is shown the method of releasing the cable holding device 25.

As the guide 11 of the cutter-coiler is lowered and guided into the casing 2 by the guide line 22 and as it enters into the cable holding device 25, it pushes into the extended dogs 28. As the guide 11 pushes into the extended dogs 28, it puts the pullback line 27 into tension and causes it to break. When the pullback line 27 breaks, the dogs 28 are released along with the cable holding device 25.

Although the system described in detail supra has been found to be most satisfactory and preferred, many variations in structure and method are possible. For example, there may only be two splitter blades required, a massive weight may be used to push down on the casing, conductors or piles instead of a subsea hammer and the device could be guided into place by divers.

Although the invention has been described with reference to the preferred embodiment, it will be understood by those skilled in the art, that additions, modifications, substitutions, deletions and other changes not specifically described, may be made in the embodiment herein, it should be understood that the details herein are to be interpreted as illustrative and not in a limited sense.

I claim:

1. An apparatus for cutting a cylindrical pile, casing or conductor pipe having a longitudinal axis, into at least two sections, wherein the cuts are made parallel to said longitudinal axis of said pile, casing or conductor pipe and further said sections are coiled into an excavation in the sea floor to an elevation below the surface of the sea floor, said apparatus having an upper end and a lower end and further comprising:

a guide, said guide is fixed to said lower end of said apparatus and said guide having an outside diameter less than the inside diameter of said cylindrical pile, casing or conductor pipe and is adapted to be placed inside of said cylindrical pile, casing or conductor pipe to keep said apparatus aligned with said cylindrical pile, casing or conductor pipe, and said guide further has an upper end and a lower end;

a spreader coiler, wherein said spreader coiler has a bottom and wherein said spreader coiler is most narrow at said bottom and wherein said spreader coiler further is fixed to said guide at said bottom of said spreader coiler.

a coiler, wherein said coiler is a half round member and wherein said coiler is further fixed to said spreader coiler;

a helmet, wherein said helmet has a lower end and an upper end and wherein said lower end of said helmet is fixed to said upper end an anvil, wherein said anvil has a lower end and an upper end and wherein said lower end of said anvil is fixed to said upper end of said helmet;

trunnions, said trunnions are fixed to said anvil;

a pile hammer, wherein said pile hammer is flexibly fixed to said anvil by said trunnions;

at least two cutter blades, wherein said cutter blades are fixed to said guide and said spreader coiler and said cutter blades are located 180 degrees apart and wherein said cutter blades are thinner in section than said spreader coiler and said guide;

a water jetting means wherein said water jetting means jets water into said sea floor and said water jetted into said sea floor displaces the soil on said sea floor and further creates an excavation around said cylindrical pipe, casing or conductor pipe and wherein said guide is inserted into said cylindrical pile, casing or conductor pipe and said pile hammer is further actuated and strikes said helmet which further induces energy and shock force into said spreader coiler and said cutter blades and wherein said cutter blades cut into said cylindrical pile, casing and conductor pipe parallel to said longitudinal axis of said cylindrical pile, casing and conductor pipe and cuts said cylindrical pile, casing and conductor pipe into at least two sections and said spreader coiler and said coiler further strikes said sections of said cylindrical pile, casing and conductor pipe and further flattens, spreads and rolls said sections into coils and said coils are depressed into said excavation in said sea floor to an elevation below said sea floor.

2. The apparatus in accordance with claim 1 wherein said pile hammer is flexibly fixed t said anvil by said trunnion means.

3. The apparatus in accordance with claim 1 wherein said jetting system has jets disposed to jet water in a horizontal plane.

4. The apparatus in accordance with claim 1 wherein said apparatus is further comprised of a cable guide means.

5. The apparatus in accordance with claim 4 wherein said cable guide means has a cable fixed to said cylindrical pile, casing and conductor pipe.

6. A method of cutting and coiling a cylindrical pile, casing or conductor pipe that is projecting above the sea floor, said cylindrical pile, casing or conductor pipe having a longitudinal axis and further cuts and coils said cylindrical pile, casing or conductor pipe to an elevation below said sea floor and parallel to said longitudinal axis and wherein the apparatus further includes a pile hammer, an anvil fixed to said pile hammer, a helmet fixed to said anvil, a spreader coiler fixed to said helmet, a coiler fixed to said spreader coiler, a guide fixed to said spreader coiler and at least two cutter blades further fixed to said spreader coiler and said guide comprising of the following steps of:

A. lowering said guide into said cylindrical pile, casing and conductor pipe;

B. striking said anvil with said pile hammer, inducing forces and shock waves into said anvil, helmet, spreader coiler, and cutter blades, causing said device to move in a downward direction parallel to said longitudinal axis of said cylindrical pile casing and conductor pipe;

C. cutting said piles, casings and conductor pipe into at least two or more sections, said sections to be parallel to the longitudinal axis of said cylindrical pipe, casing and conductor pipe;

D. ;

flattening said sections horizontally or perpendicularly to said longitudinal axis of said cylindrical pile, casing and conductor pipe;

E.

Striking said sections with said coiler further forcing said sections to roll into a coil.

7. The method in accordance with claim 6 wherein said cylindrical pile, casing or conductor pipe is cut and coiled to an elevation below said sea floor and wherein said apparatus further includes at least one vertical water jet nozzle, wherein said vertical water jet nozzle jets water in an assembly downward direction into said sea floor.

8. The method in accordance with claim 7 wherein said vertical water jet nozzle jets water into said sea floor and wherein said water jet forms an excavation in said sea floor around said pile casing or conductor pipe.

9. The method in accordance with claim 8 wherein said coils are rolled up in said excavation below said sea floor.

* * * * *